US011971196B2

(12) United States Patent
Post et al.

(10) Patent No.: US 11,971,196 B2
(45) **Date of Patent: *Apr. 30, 2024**

(54) WATER HEATER BLOWER ASSEMBLY HAVING A LOW EXHAUST PORT

(71) Applicant: Regal Beloit America, Inc., Beloit, WI (US)

(72) Inventors: Steven W. Post, Cassville, MO (US); Jeffrey Jay Long, Purdy, MO (US); William S. Gatley, Jr., Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 270 days.

This patent is subject to a terminal disclaimer.

(21) Appl. No.: 17/547,859

(22) Filed: Dec. 10, 2021

(65) Prior Publication Data

US 2022/0099337 A1 Mar. 31, 2022

Related U.S. Application Data

(63) Continuation of application No. 16/516,851, filed on Jul. 19, 2019, now Pat. No. 11,215,379, which is a (Continued)

(51) Int. Cl.

| | |
|---|---|
| ***F24H 9/00*** | (2022.01) |
| ***F23L 17/00*** | (2006.01) |
| ***F24H 1/20*** | (2022.01) |

(52) U.S. Cl.

CPC ..... *F24H 9/0031* (2013.01); *F23L 17/005* (2013.01); *F24H 1/205* (2013.01)

(58) Field of Classification Search

CPC ..... F24H 9/0031; F24H 1/205; F23L 17/005; F23L 17/06; F23L 17/12; F23L 17/14; F04D 29/422; F04D 29/4226

See application file for complete search history.

(56) References Cited

U.S. PATENT DOCUMENTS

| | | |
|---|---|---|
| 2,671,503 A | 3/1954 | Logan |
| 4,603,680 A | 8/1986 | Dempsey et al. |

(Continued)

FOREIGN PATENT DOCUMENTS

| | | |
|---|---|---|
| CN | 205823736 U | 12/2016 |
| JP | 2002180998 A | 6/2002 |

OTHER PUBLICATIONS

Decision on Appeal, Appeal No. 2021-000308, for U.S. Appl. No. 15/349,674, dated May 17, 2021.

(Continued)

*Primary Examiner* — Steven S Anderson, II

(74) *Attorney, Agent, or Firm* — Thompson Coburn LLP

(57) ABSTRACT

A draft inducer blower assembly for use with a water heater has a housing, a motor, and a fan. The housing has an exhaust volute surrounding the fan and a base adapted to be mounted atop a water heater. The housing has an inlet port adapted to receive exhaust gas from the water heater. The fan is connected to the motor for rotation about a rotation axis. The exhaust volute has a cut-off at a cut-off angle relative to the rotation axis. The exhaust volute has an exhaust outlet passageway that extends to an exhaust port. The exhaust port is lower than the top of the exhaust volute.

9 Claims, 8 Drawing Sheets

Related U.S. Application Data continuation of application No. 15/381,443, filed on Dec. 16, 2016, now Pat. No. 10,443,891, which is a continuation-in-part of application No. 15/349,674, filed on Nov. 11, 2016, now Pat. No. 11,306,944, which is a continuation-in-part of application No. 15/183,040, filed on Jun. 15, 2016, now Pat. No. 11,015,836.

(56) References Cited

U.S. PATENT DOCUMENTS

| | | | |
|---|---|---|---|
| 4,750,433 | A | 6/1988 | Guzorek |
| 4,867,106 | A | 9/1989 | Staats |
| 4,899,726 | A | 2/1990 | Waterman |
| 5,286,162 | A | 2/1994 | Veres |
| 7,354,244 | B2 | 4/2008 | Hasbargen et al. |
| 11,215,379 | B2 * | 1/2022 | Post ..... F24H 9/0031 |
| 2004/0258546 | A1 | 12/2004 | Gatley |
| 2008/0131283 | A1 | 6/2008 | Elsaesser et al. |
| 2012/0180737 | A1 | 7/2012 | English et al. |
| 2012/0180826 | A1 | 7/2012 | Guo et al. |
| 2014/0137812 | A1 | 5/2014 | Branecky et al. |
| 2016/0369811 | A1 | 12/2016 | Ling et al. |
| 2017/0067481 | A1 | 3/2017 | Ruzica |

OTHER PUBLICATIONS

Decision on Appeal, Appeal No. 2021-001618, for U.S. Appl. No. 16/516,851, dated May 13, 2021.

* cited by examiner

WATER HEATER BLOWER ASSEMBLY HAVING A LOW EXHAUST PORT

CROSS-REFERENCE TO RELATED APPLICATIONS

This application is a continuation of U.S. patent application Ser. No. 16/516,851, filed Jul. 19, 2019, which is a continuation of U.S. patent application Ser. No. 15/381,443, filed Dec. 16, 2016, now U.S. Pat. No. 10,443,891, issued Oct. 15, 2019, which is a CIP of U.S. patent application Ser. No. 15/349,674, filed Nov. 11, 2016, which is a CIP of U.S. patent application Ser. No. 15/183,040, filed Jun. 15, 2016, now U.S. Pat. No. 11,015,836, issued May 25, 2021, each entitled WATER HEATER BLOWER ASSEMBLY HAVING A LOW EXHAUST PORT, the entire disclosures of each of which are incorporated herein by reference.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

The present invention pertains to draft inducer blower assemblies for use with water heaters having burners and gas-fueled water heaters having a draft inducer blower assembly.

General Background

Gas-fueled water heaters typically comprise a draft inducer blower assembly that provides combustion air to the burner. A draft inducer blower assembly is most commonly attached to the top of the water heater and therefore takes up vertical space that, in some circumstances, can be a concern. Moreover, in some circumstances such blower assemblies must be connected to vertical vent lines, while in other circumstances they must be connected to horizontal vent lines.

SUMMARY

The configuration of a draft inducer blower assembly in accordance with the present invention allows for the blower assembly to be connected to either vertical or horizontal vent lines, without altering the components of the blower assembly itself, even in situations where vertical/clearance is a concern. By not having to adjust the blower assemblies to account for specific installation needs, installation costs are reduced, as are the skills required to install water heaters provided with such a draft inducer blower assembly.

In one aspect of the disclosure, a draft inducer blower assembly for use with a gas-fueled water heater comprises a housing, a motor, and a fan. The housing has an exhaust volute surrounding the fan, an inlet port, and an exhaust port, the inlet port and the exhaust port being in fluid communication with the exhaust volute. The housing is configured and adapted to be mounted atop a water heater. The inlet port is adapted and configured to receive exhaust gas from the water heater when the base is mounted atop the water heater. The fan is connected to the motor for rotation about a rotation axis. The exhaust volute has a cut-off at a cut-off angle relative to the rotation axis. The cut-off angle extends at an angle that is no more than thirty degrees positive from horizontal. The exhaust volute has an exhaust outlet passageway including a terminal portion that extends to the exhaust port. The housing is configured and adapted such that, when the housing is oriented so that the terminal portion of the exhaust outlet passageway extends vertically upwardly, the cut-off angle is not more than thirty degrees positive from horizontal.

Another aspect of the disclosure is a draft inducer blower assembly for use with a gas-fueled water heater. The blower assembly comprises a housing, a motor, and a fan. The housing has an exhaust volute surrounding the fan, an inlet port, and an exhaust port, the inlet and exhaust ports being in fluid communication with the exhaust volute. The housing is configured and adapted to be mounted atop the water heater. The housing has an inlet port adapted and configured to receive exhaust gas from the water heater when the housing is mounted atop the water heater. The fan is connected to the motor for rotation about a rotation axis. The exhaust volute has a cut-off at a cut-off angle relative to the rotation axis. The exhaust volute has an exhaust outlet passageway that extends to an exhaust port. The housing is configured and adapted such that, when the housing is oriented to discharge exhaust gas vertically upwardly through the exhaust port, the exhaust port is lower than the top of the exhaust volute.

Another aspect of the disclosure is a draft inducer blower assembly for use with a gas-fueled water heater. The blower assembly comprises a housing, a motor, and a fan. The housing has an exhaust volute surrounding the fan, an inlet port, and an exhaust port, the inlet and exhaust ports being in fluid communication with the exhaust volute. The housing is configured and adapted to be mounted atop the water heater. The housing has an inlet port adapted and configured to receive exhaust gas from the water heater when the housing is mounted atop the water heater. The fan is connected to the motor for rotation about a rotation axis. The exhaust volute has a cut-off at a cut-off angle relative to the rotation axis. The housing is configured and adapted such that, when the housing is oriented to discharge exhaust gas vertically upwardly through the exhaust port, the cut-off angle is not more than thirty degrees positive from horizontal.

Further features and advantages of the present invention, as well as the operation of the invention, are described in detail below with reference to the accompanying drawings.

Figure 1:
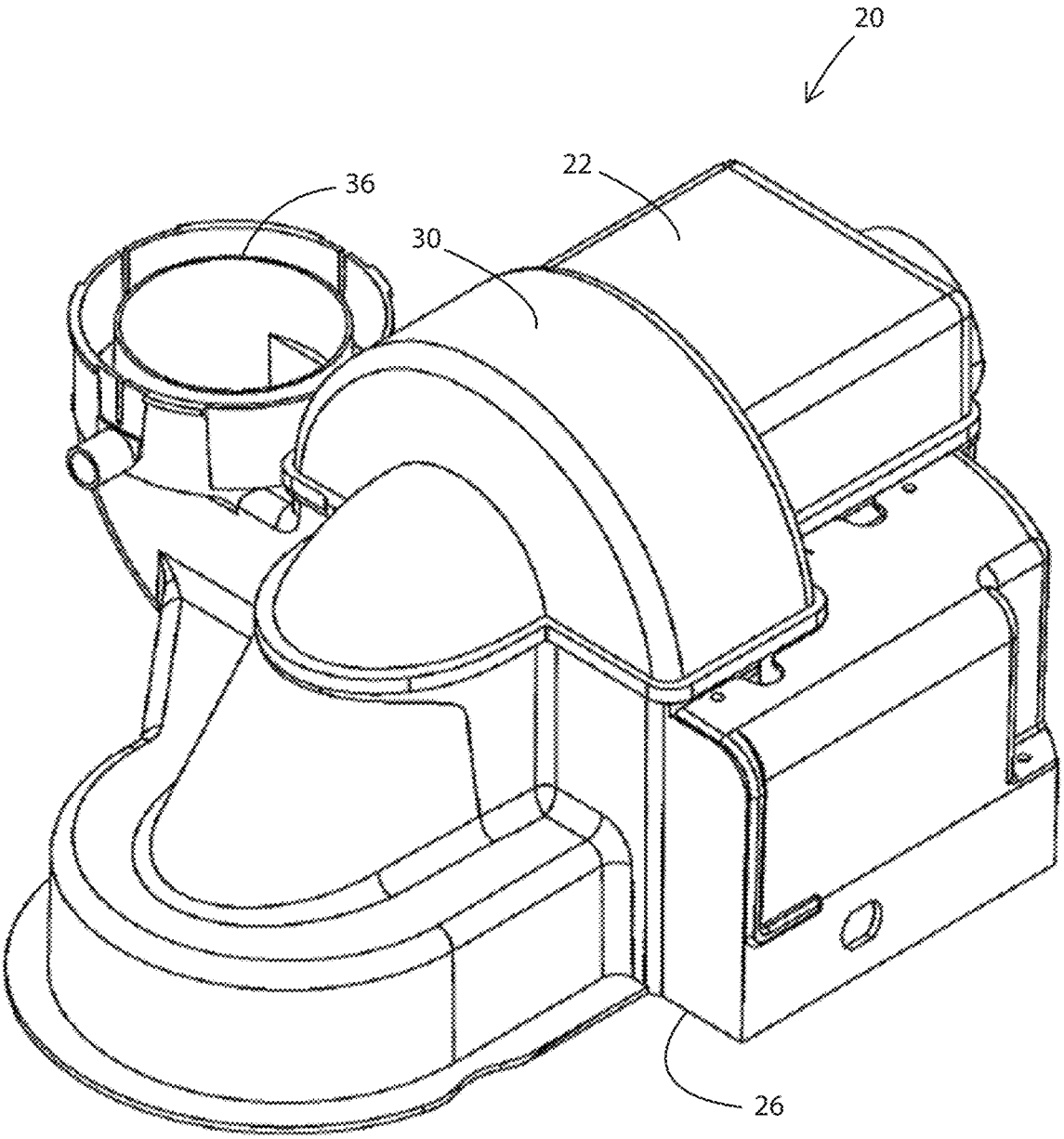
FIG. 1 is a perspective view of an embodiment of a draft inducer blower assembly in accordance with the invention.

Reference numerals in the written specification and in the drawing figures indicate corresponding items.

DETAILED DESCRIPTION

Figure 7:
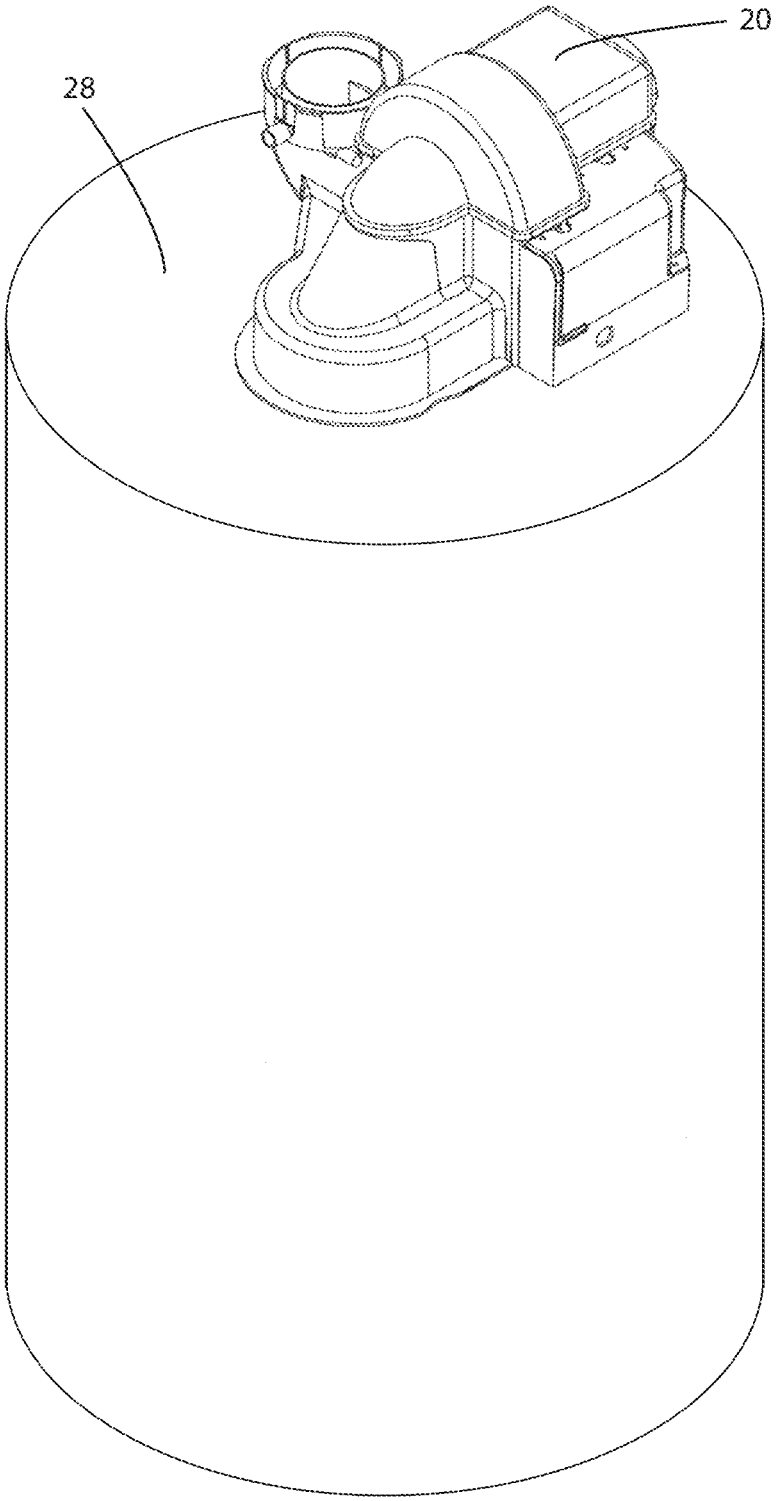
FIG. 7 is a perspective view of a water heater comprising the blower assembly shown in FIGS. 1-3.

An embodiment of a draft inducer blower assembly 20 in accordance with the invention is shown in the figures. The blower assembly 20 comprises a housing 22 that houses a fan 24. The base 26 of the housing 22 is configured to attach atop a water heater 28, as shown in FIG. 7. The housing 22 also forms an exhaust volute 30 in which the fan 24 resides. An inlet passageway 32 extends from an opening in the base of the housing to the fan 24 and is adapted to connect to the exhaust outlet not shown of a gas-fueled water heater. The exhaust volute 30 comprises an exhaust outlet passageway 34 that extends to an exhaust port 36. The fan 24 is attached to a motor 38 that rotationally drives the fan about a rotation axis when in use.

Figure 3:
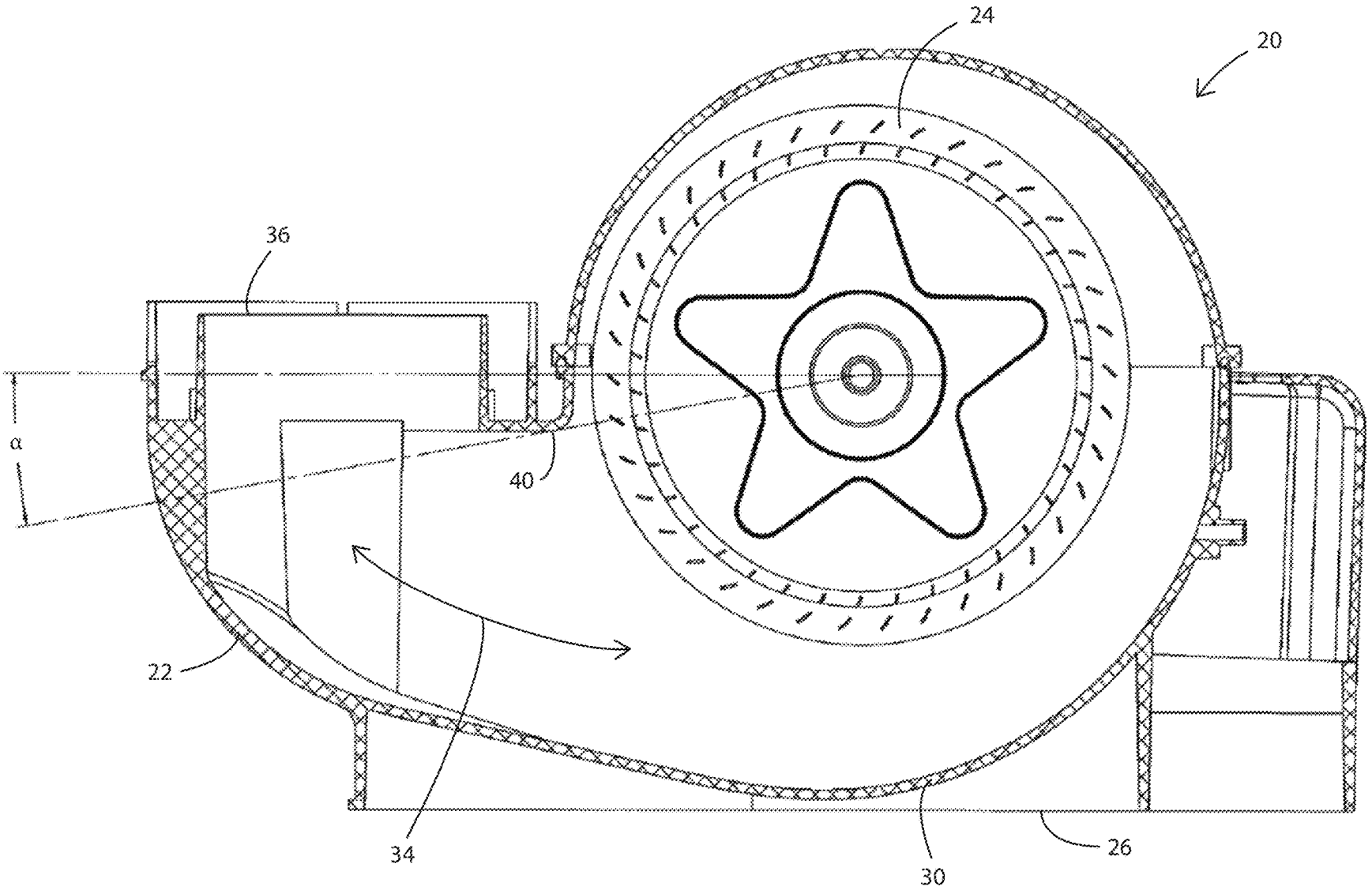
FIG. 3 is an elevational cross-sectional view of the draft inducer blower assembly shown in FIGS. 1 and 2, taken about a plane that is perpendicular to the rotation axis and that lies midway through the thickness of the volute of the blower assembly.

As shown in FIG. 3, the exhaust volute 30 has a cut-off 40 that is oriented at a cut-off angle $\alpha$ relative to the rotation axis. The cut-off angle $\alpha$ is appreciably low, preferably no more than thirty degrees positive from horizontal, and more preferably no more than twenty degrees positive from horizontal, and more preferably the cut-off angle $\alpha$ is negative from horizontal as is shown in FIG. 3. The exhaust outlet passageway 34 extends beneath the cut-off 40 before reaching the exhaust port 36. Preferably, the exhaust outlet passageway 34 turns upward as it extends toward the exhaust port 36 after passing beneath the cut-off 40 to the extent the exhaust port faces vertically upward. However, the exhaust outlet passageway 34 need not extend beneath the cut-off 40 and need not turn upward and the exhaust port 36 could face horizontally. Regardless, the exhaust port 36 is preferably located at an elevation lower than the top of the exhaust volute 30 and is also preferably located at an elevation lower than the top of the fan 24.

Figure 4:
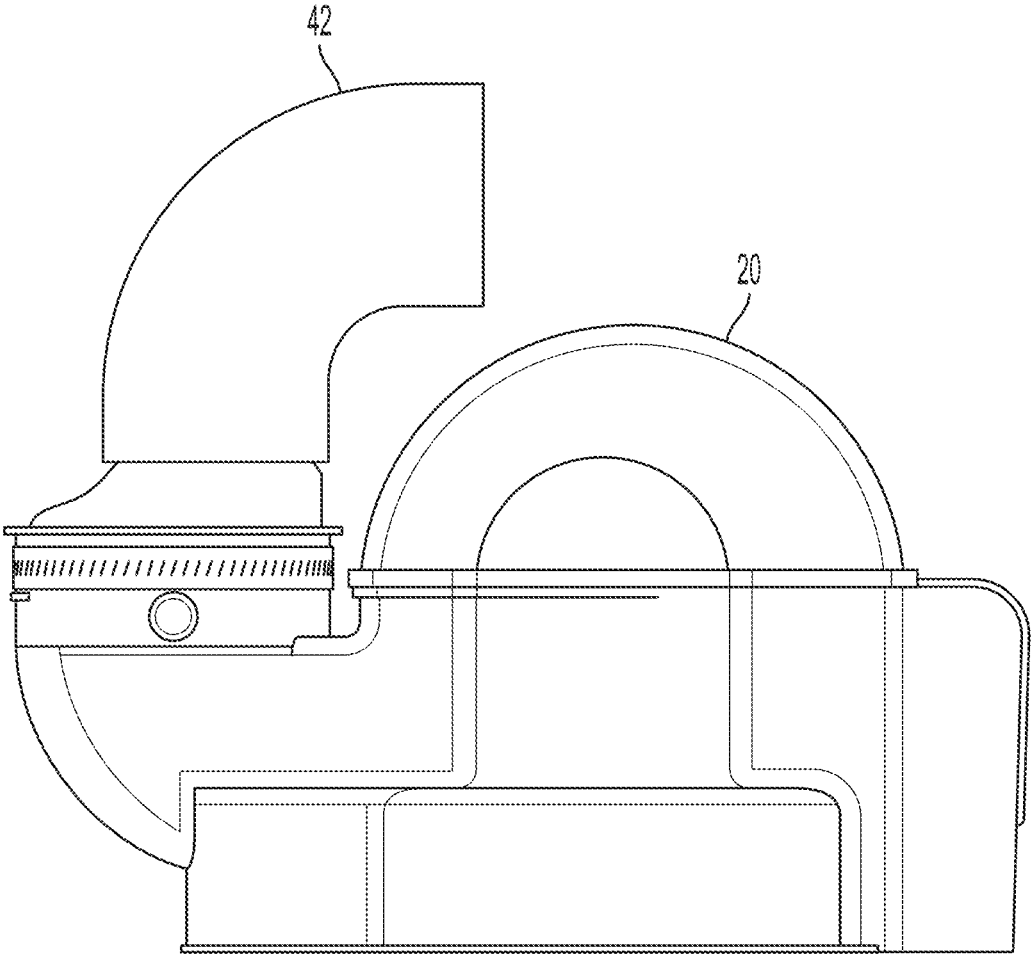
FIG. 4 is a front elevation view of the draft inducer blower assembly shown in FIGS. 1-3, showing a ninety degree pipe elbow attached to the blower assembly.
Figure 5:
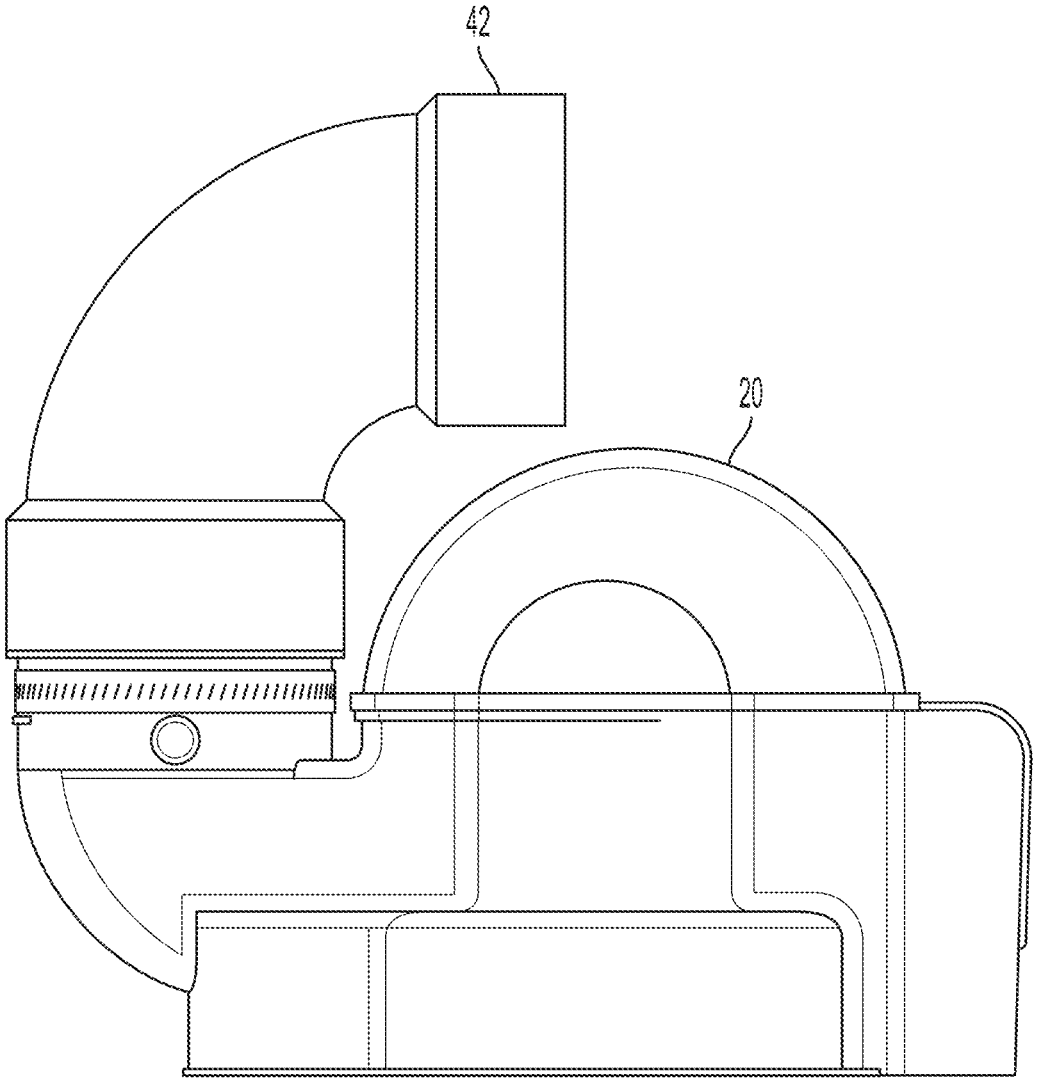
FIG. 5 is a front elevation view of the draft inducer blower assembly shown in FIGS. 1-3, showing another ninety degree pipe elbow attached to the blower assembly.
Figure 6:
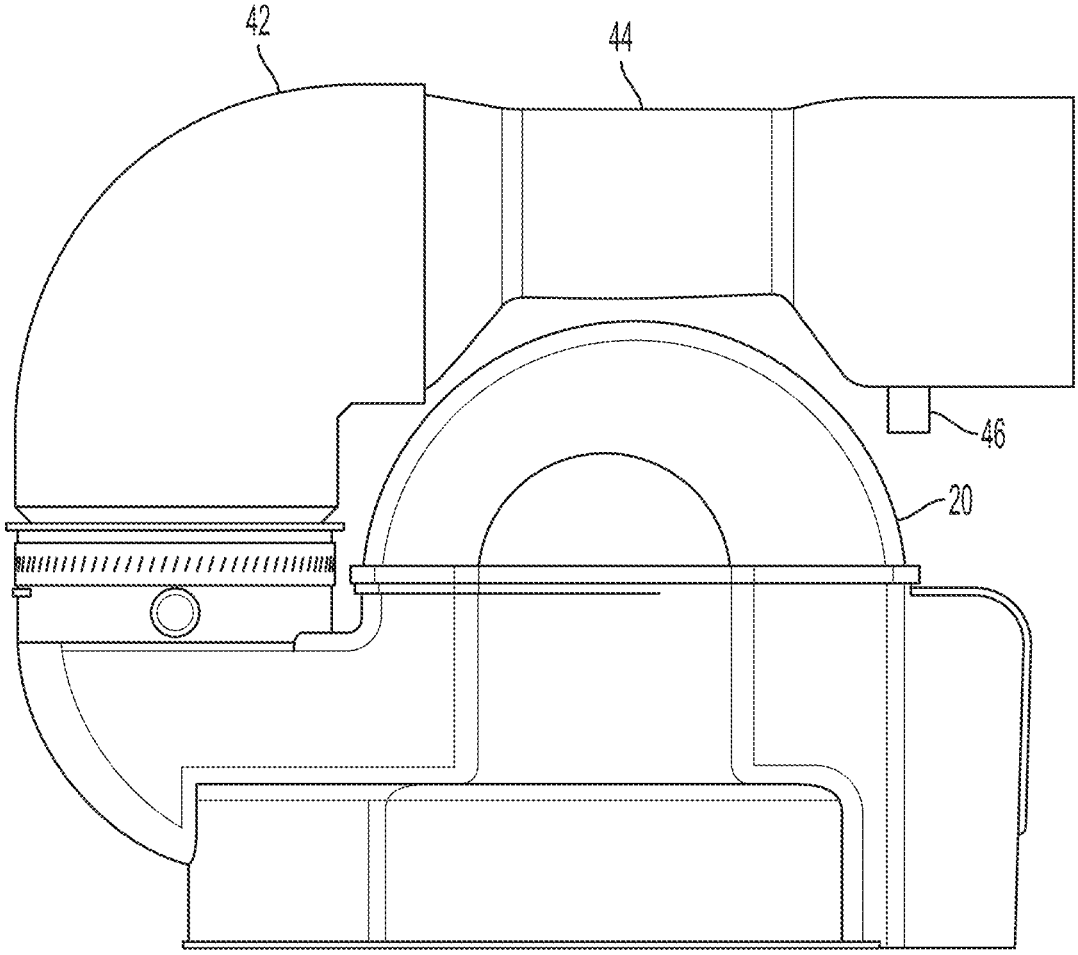
FIG. 6 is a front elevation view of the draft inducer blower assembly shown in FIGS. 1-3, showing an ultra-low ninety degree elbow and cross-over pipe attached to the blower assembly.

The configuration of the blower assembly 20 provides considerable advantages when the clearances above the tank of a water heater are limited. As shown in FIGS. 1 and 7, the blower assembly 20 is ready to be connected to a vertically oriented exhaust flue pipe not shown. Additionally, as shown in FIGS. 4-6, the blower assembly 20 can be used with elbow flue pipe fittings 42 such that the blower assembly can be connected to horizontal flue piping. Notably and as should be appreciated from FIGS. 4-6, by providing an exhaust port 36 that lies appreciably beneath the top of the exhaust volute 30 of the housing 22, especially an exhaust port 36 that faces vertically upward, the transition to horizontal flue piping can be made just above the top of the exhaust volute 30, which is necessary in many low clearance situations. As is shown in FIG. 6, a unique cross-over pipe 44 can also be provided, which can bridge over the top of the exhaust volute 30 when clearance above a water heater tank demands a transition that is even closer to the base 26 of the blower assembly 20. The opposite ends of the cross-over pipe 44 have circular cross-sections while the bottom of the center section necks in from the bottom side and also widens so as not to create a flow restriction. The downstream end of the cross-over pipe comprises a drain 46 for water that condensates, since such water is not able to drain back to the blower assembly 20. No modification of the blower assembly 20 itself is needed to convert the blower assembly 20 from a vertical flue configuration to a horizontal flue configuration. In the embodiment of FIGS. 1-8, the exhaust volute and the base are fixed relative to each other, and more particularly are non-adjustably fixed relative to each other. But it is to be understood that in an alternative embodiment (not shown) the exhaust volute is rotatable relative to the base of the blower assembly and is adjustably fixed.

Figure 2:
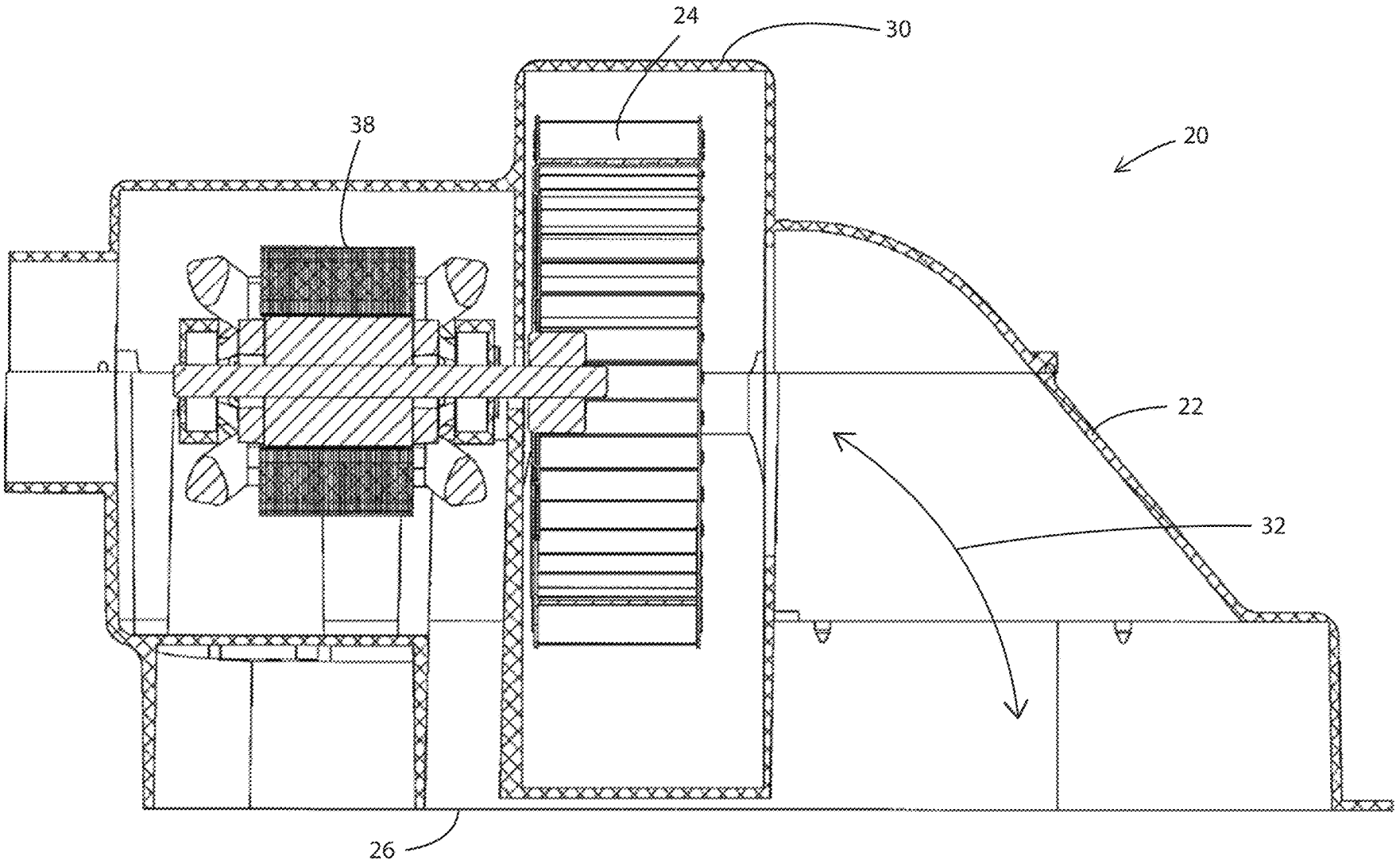
FIG. 2 is an elevational cross-sectional view of the draft inducer blower assembly shown in FIG. 1, taken about the rotation axis of the fan.
Figure 8:
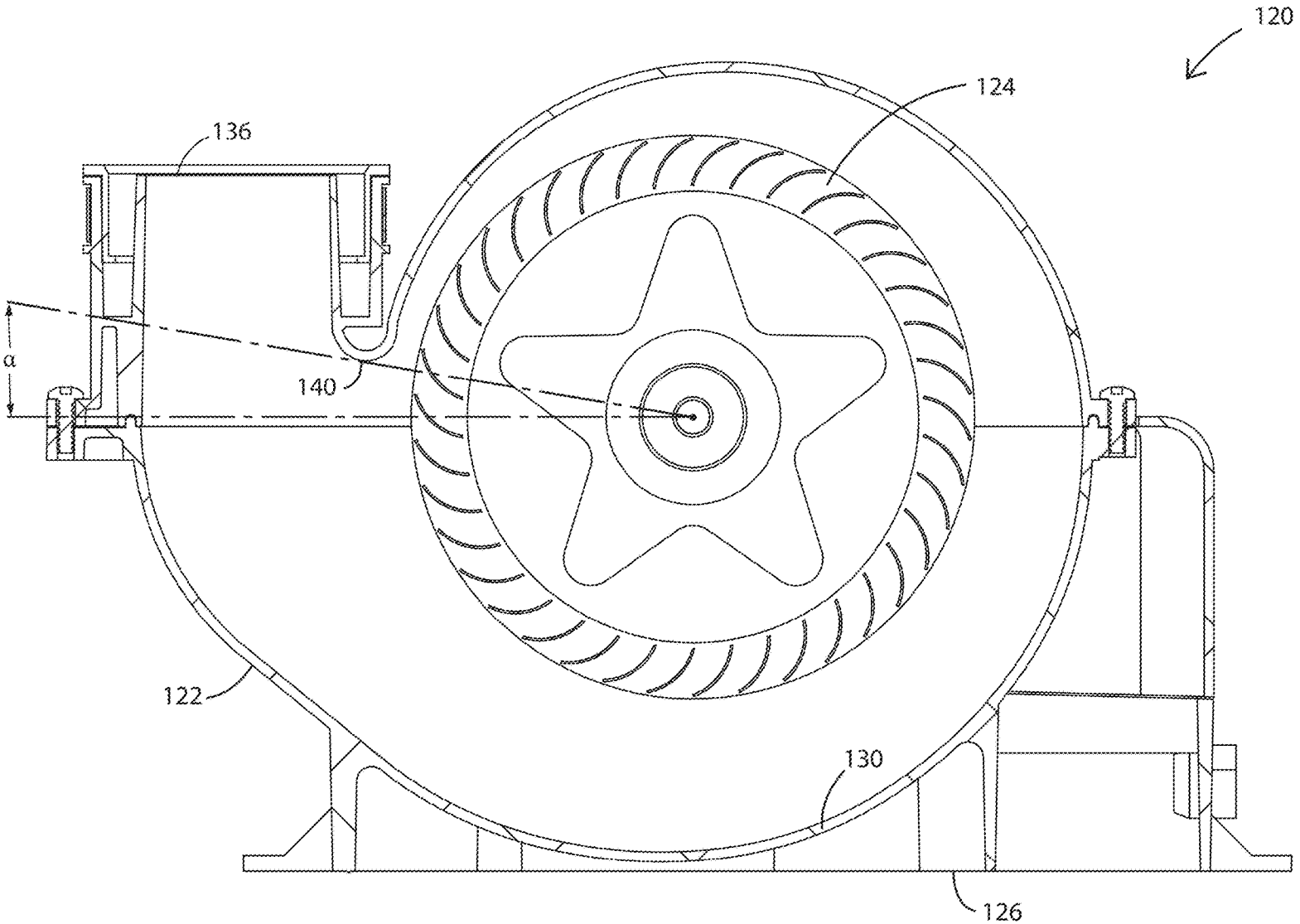
FIG. 8 is an elevational cross-sectional view of another embodiment of a draft inducer blower assembly, taken about a plane that is perpendicular to the rotation axis and that lies midway through the thickness of the volute of the blower assembly.

Referring now to FIG. 8, another embodiment of a blower assembly is generally indicated by the reference numeral 120. The primary difference between the blower assembly 120 of FIG. 8 and the blower assembly 20 of FIGS. 1-3 is the cut-off angle. Except as noted herein, the above description of the blower assembly 20 of FIGS. 1-3 applies equally to the blower assembly 120 of FIG. 8, but the reference numbers of comparable features of the blower assembly 120 of FIG. 8 are preceded by the prefix "1". In the blower assembly 120 of this embodiment, the cut-off 140 is oriented at a cut-off angle $\alpha$ approximately ten degrees positive from horizontal. Preferably, the cut-off angle $\alpha$ is not more than thirty degrees positive from horizontal.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit.

What is claimed is:

1. A draft inducer blower assembly for use with a fossil-fuel water heater, the blower assembly comprising a housing, a motor, a fan;

the housing having an exhaust volute surrounding the fan, an inlet port, and an exhaust port, the inlet port and the exhaust port being in fluid communication with the exhaust volute; the housing being configured and adapted to be mounted atop the water heater, the inlet port being adapted and configured to receive exhaust gas from the water heater when the housing is mounted atop the water heater, the fan being connected to the motor for rotation about a rotation axis, the exhaust volute having a cut-off at a cut-off angle relative to the rotation axis, the exhaust volute having an exhaust outlet passageway including a terminal portion that extends to the exhaust port;

the housing being configured and adapted such that, when the housing is oriented so that the terminal portion of the exhaust outlet passageway extends vertically upwardly, the cut-off angle is not more than thirty degrees positive from horizontal.

2. A draft inducer blower assembly in accordance with claim 1 wherein the housing is configured and adapted such that the exhaust port is lower than a top of the exhaust volute when the housing is oriented so that the terminal portion of the exhaust passageway extends vertically upwardly.

3. A draft inducer blower assembly in accordance with claim 1 wherein the housing is configured and adapted to be mounted atop the water heater such that the exhaust outlet passageway extends beneath the cut-off and thereafter extends vertically upwardly to the exhaust port to discharge exhaust gas vertically upwardly through the exhaust port.

4. A draft inducer blower assembly for use with a fossil-fuel water heater, the blower assembly comprising:

a housing, a motor, and a fan;

the housing having an exhaust volute surrounding the fan, an inlet port, and an exhaust port, the inlet port and the exhaust port being in fluid communication with the exhaust volute, the housing being configured and adapted to be mounted atop the water heater, the inlet port being adapted and configured to receive exhaust gas from the water heater when the housing is mounted atop the water heater, the fan being connected to the motor for rotation about a rotation axis, the housing being configured and adapted such that, when the housing is oriented to discharge exhaust gas vertically upwardly through the exhaust port, the exhaust port is lower than a top of the exhaust volute.

5. A draft inducer blower assembly in accordance with claim 4 wherein the housing is configured and adapted to discharge exhaust gas vertically upwardly through the exhaust port when the exhaust port faces vertically upward.

6. A draft inducer blower assembly in accordance with claim 4 wherein the exhaust volute has a cut-off at a cut-off angle relative to the rotation axis, and the housing is configured and adapted such that the cut-off angle extends at an angle that is not more than thirty degrees positive from horizontal when the housing is oriented to discharge exhaust gas vertically upwardly through the exhaust port.

7. A draft inducer blower assembly in accordance with claim 4 wherein the exhaust volute has a cut-off at a cut-off angle relative to the rotation axis, and the housing is configured and adapted such that the cut-off angle is negative from horizontal when the housing is oriented to discharge exhaust gas vertically upwardly through the exhaust port.

8. A draft inducer blower assembly for use with a fossil-fuel water heater, the blower assembly comprising a housing, a motor, and a fan;

the housing having an exhaust volute surrounding the fan, an inlet port, and an exhaust port, the inlet port and the exhaust port being in fluid communication with the exhaust volute; the housing being configured and adapted to be mounted atop the water heater, the inlet port being adapted and configured to receive exhaust gas from the water heater when the housing is mounted atop the water heater, the fan being connected to the motor for rotation about a rotation axis, the exhaust volute having a cut-off at a cut-off angle relative to the rotation axis, the housing being configured and adapted such that, when the housing is oriented to discharge exhaust gas vertically upwardly through the exhaust port, the cut-off angle is not more than thirty degrees positive from horizontal.

9. A draft inducer blower assembly in accordance with claim 8 wherein the exhaust volute has an exhaust outlet passageway including a terminal portion that extends to the exhaust port, wherein the housing is configured and adapted to be mounted atop the water heater such that the exhaust outlet passageway extends beneath the cut-off and the terminal portion of the exhaust outlet passageway extends vertically upwardly.

* * * * *